US009296522B2

(12) United States Patent
Tamaoki

(10) Patent No.: US 9,296,522 B2
(45) Date of Patent: Mar. 29, 2016

(54) EASILY TEARABLE ZIPPER TAPE AND PACKAGING BAG WITH EASILY TEARABLE ZIPPER TAPE

(71) Applicant: Idemitsu Unitech Co., Ltd., Tokyo (JP)

(72) Inventor: Tomohiko Tamaoki, Sodegaura (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 0 days.

(21) Appl. No.: 14/557,981

(22) Filed: Dec. 2, 2014

(65) Prior Publication Data

US 2015/0086139 A1 Mar. 26, 2015

Related U.S. Application Data

(63) Continuation of application No. 13/148,102, filed as application No. PCT/JP2010/000670 on Feb. 4, 2010, now abandoned.

(30) Foreign Application Priority Data

Feb. 6, 2009 (JP) ..... 2009-026793

(51) Int. Cl.
*B65D 33/25* (2006.01)
*B65D 77/10* (2006.01)

(52) U.S. Cl.
CPC ..... *B65D 33/25* (2013.01); *B65D 33/2533* (2013.01); *B65D 33/2541* (2013.01); *B65D 77/10* (2013.01)

(58) Field of Classification Search
CPC ..... B65D 33/2533; B65D 33/2508; B65D 33/2541; B65D 75/5805; B65D 33/25; B65D 77/10; Y10S 24/50
USPC ..... 383/61.2, 63, 200, 203, 207, 208, 210, 383/210.1
See application file for complete search history.

(56) References Cited

U.S. PATENT DOCUMENTS 3,780,781 A 12/1973 Uramoto
3,827,472 A 8/1974 Uramoto
4,947,525 A 8/1990 Van Erden (Continued)

FOREIGN PATENT DOCUMENTS

JP 63-62349 U 4/1988
JP 8-268442 A 10/1996

(Continued)

OTHER PUBLICATIONS

International Search Report of PCT/JP2010/000670 (Apr. 12, 2010).

*Primary Examiner* — J. Gregory Pickett
*Assistant Examiner* — Peter Helvey
(74) *Attorney, Agent, or Firm* — Millen, White, Zelano & Branigan, P.C.

(57) ABSTRACT

A thin portion is provided near an opening of a bag body to a main body of a belt-like base connected to an engagement portion. The thin portion is provided between a thick first projecting portion and a thick second projecting portion. The thin portion is thinner than the first projecting portion and the second projecting portion. On the thin portion, ribs are provided in plural lines.

27 Claims, 3 Drawing Sheets

(56) References Cited

U.S. PATENT DOCUMENTS

| | | | |
|---|---|---|---|
| 5,527,112 | A | 6/1996 | Dais et al. |
| 5,564,834 | A | 10/1996 | Porchia et al. |
| 5,660,479 | A | 8/1997 | May et al. |
| 5,664,303 | A | 9/1997 | Johnson |
| 5,672,009 | A | 9/1997 | Malin |
| 5,832,145 | A | 11/1998 | Dais et al. |
| 6,030,122 | A | 2/2000 | Ramsey et al. |
| 8,066,434 | B2 | 11/2011 | Nanba et al. |
| 8,540,428 | B2 | 9/2013 | Nanba |
| 2004/0013323 | A1 | 1/2004 | Withers |
| 2007/0206888 | A1 | 9/2007 | Chang |
| 2008/0285896 | A1 | 11/2008 | Taheri |

FOREIGN PATENT DOCUMENTS

| | | | |
|---|---|---|---|
| JP | 9-301383 | A | 11/1997 |
| JP | 2003-212248 | A | 7/2003 |
| JP | 2003-246332 | A | 9/2003 |
| JP | 2004-511401 | A | 4/2004 |
| JP | 2008-44663 | A | 2/2008 |
| WO | WO 2008/035494 | A1 | 3/2008 |

EASILY TEARABLE ZIPPER TAPE AND PACKAGING BAG WITH EASILY TEARABLE ZIPPER TAPE

This application is a continuation of U.S. patent application Ser. No. 13/148,102, filed on Aug. 5, 2011 which is the National Stage Entry of PCT/JP2010/000670 filed on Feb. 4, 2010.

TECHNICAL FIELD

The present invention relates to an easily tearable zipper tape and a packaging bag with the easily tearable zipper tape.

BACKGROUND ART

As a packaging material for packaging various articles such as food, medicine, medical products and miscellaneous goods, a packaging bag provided with a zipper tape have been used, in which a pair of belt-like zipper tapes respectively including a male member and a female member that are mated with each other is disposed on an opening of the bag, the zipper tapes capable of being opened from the mated state and closable again.

Such a packaging bag provided with a zipper tape is sealed at an upper side of the zipper tape. When the packaging bag is to be opened, a film forming a bag body are torn apart starting from notches and the like provided on either side of the packaging bag.

When the packaging bag is to be thus opened, the film of the packaging bag is cut closely along the zipper tape to cause difficulty in pinching the bag body. Accordingly, a technique has been demanded that allows the film of the bag body to be cut at a predetermined position.

For instance, as disclosed in Patent Literature 1, such an arrangement that a packaging bag can easily be cut at a predetermined position has been known.

In the packaging bag disclosed in Patent Literature 1, a belt-like base of a male member of a zipper tape attached to an inner surface of a bag body includes: a main body on which an engagement portion is provided; a first projecting portion provided to the main body near an opening of the packaging bag; a thin portion provided to the first projecting portion near the opening; and a second projecting portion provided to the thin portion near the opening. A belt-like base of a female member includes: a main body; a first projecting portion; a thin portion; and a second projecting portion. When the zipper tape is fused onto the bag body, a gap is formed between the thin portions and a film of the bag body.

Since the first and second projecting portions provided across the thin portion are produced thicker than the thin portion, even when a cutting line goes out of the thin portion, the thick first and second projecting portions are not cut. Accordingly, level differences are produced between the thin portion and the first projecting portion and between the thin portion and the second projecting portion, so that the thin portion is easily cut along the level differences.

CITATION LIST

Patent Literature

Patent Literature 1: WO2008/035494

SUMMARY OF THE INVENTION

Problems to be Solved by the Invention

Even in a typical zipper tape cuttable at different levels, when the zipper tape is provided with a thin cutting portion formed of a relatively highly rigid material (e.g., polypropylene), the zipper tape can easily be opened without stretching the material.

However, when a cutting portion is formed of a less rigid material (e.g., LL material), the cutting portion may be stretched, whereby tearing resistance may be increased because of polymer orientation at the stretched cutting portion.

Moreover, when the above typical zipper tape as disclosed in Patent Literature 1 is formed of a less rigid LL material, since flexion strength of the thin portion is remarkably weak, the thin portion may be bent in manufacturing, thus failing to exhibit cuttability.

In consideration of the above, an object of the invention is to provide an easily tearable zipper tape that can easily be cut at a predetermined position irrespective of rigidity of a material when opening a packaging bag, while failure to exhibit cuttability caused by flexion of the zipper tape in manufacturing is avoided, and a packaging bag with the easily tearable zipper tape

Means for Solving the Problems

An easily tearable zipper tape according to an aspect of the invention is attached to an inner surface of a packaging bag, the easily tearable zipper tape including: an engagement portion at which a pair of male member and a female member are mated with each other; and belt-like bases provided continuously to the engagement portion, in which at least one of the belt-like bases includes: a main body on which the engagement portion is provided; a first projecting portion provided to the main body near an opening of the packaging bag, the first projecting portion being thicker than the main body; a thin portion provided to the first projecting portion near the opening, the thin portion being thinner than the first projecting portion and the main body; a second projecting portion provided to the thin portion near the opening, the second projecting portion being thicker than the thin portion and the main body; and a rib provided on at least one surface of the thin portion.

In the aspect of the invention, the rib is preferably provided on both surfaces of the thin portion.

Further, the rib(s) (with a height from the thin portion) is preferably formed to be from 1.1 times to 5 times as thick as the thin portion.

In the aspect of the invention, the rib preferably includes a plurality of ribs.

When the rib includes a plurality of ribs, a distance between the ribs is preferably in a range from 0.05 mm to 2 mm.

In the aspect of the invention, it is preferable that a thickness of the thin portion is 0.12 mm or less, and a thickness of each of the first projecting portion and the second projecting portion is in a range from 0.20 mm to 1 mm.

In the aspect of the invention, it is preferable that a width of the thin portion is in a range from 0.5 mm to 5 mm.

In the aspect of the invention, the thin portion, the first projecting portion and the second projecting portion are formed of the same kind of resins.

A packaging bag provided with an easily tearable zipper tape according to another aspect of the invention includes: a packaging bag having an opening through which contents are fed; and the easily tearable zipper tape according to the aspect of the invention which is attached to an inner surface of the packaging bag.

In the another aspect of the invention, the thin portion of the easily tearable zipper tape in the aspect of the invention is not preferably bonded to the inner surface of the packaging bag.

With this arrangement, rigidity of the thin portion against bend is further improved to make the thin portion less bendable, so that failure to obtain cuttability caused by the bent thin portion being attached to the packaging bag can be avoided. Moreover, in opening the bag, even when the thin portion is cut as a tear guide piece and a cutting line erroneously goes out of the thin portion, the thick first and second projecting portions are not to be cut, so that tearability can be improved for an easy opening.

DESCRIPTION OF EXEMPLARY EMBODIMENT

An exemplary embodiment of the invention will be described below with reference to the attached drawings.

Arrangement of Packaging Bag with Easily Tearable Zipper Tape

Figure 1:
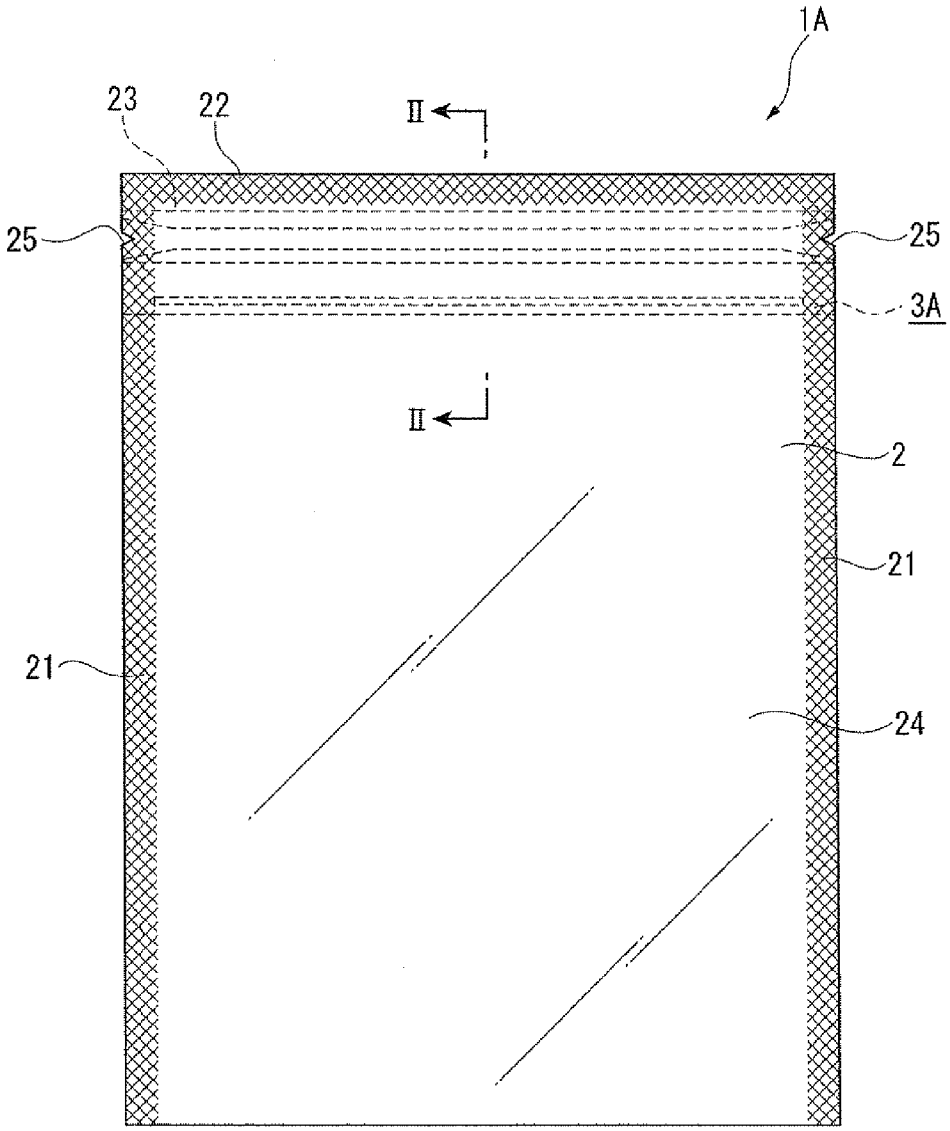
FIG. 1 is a front view showing a packaging bag provided with a zipper tape according to an exemplary embodiment of the invention.
Figure 2:
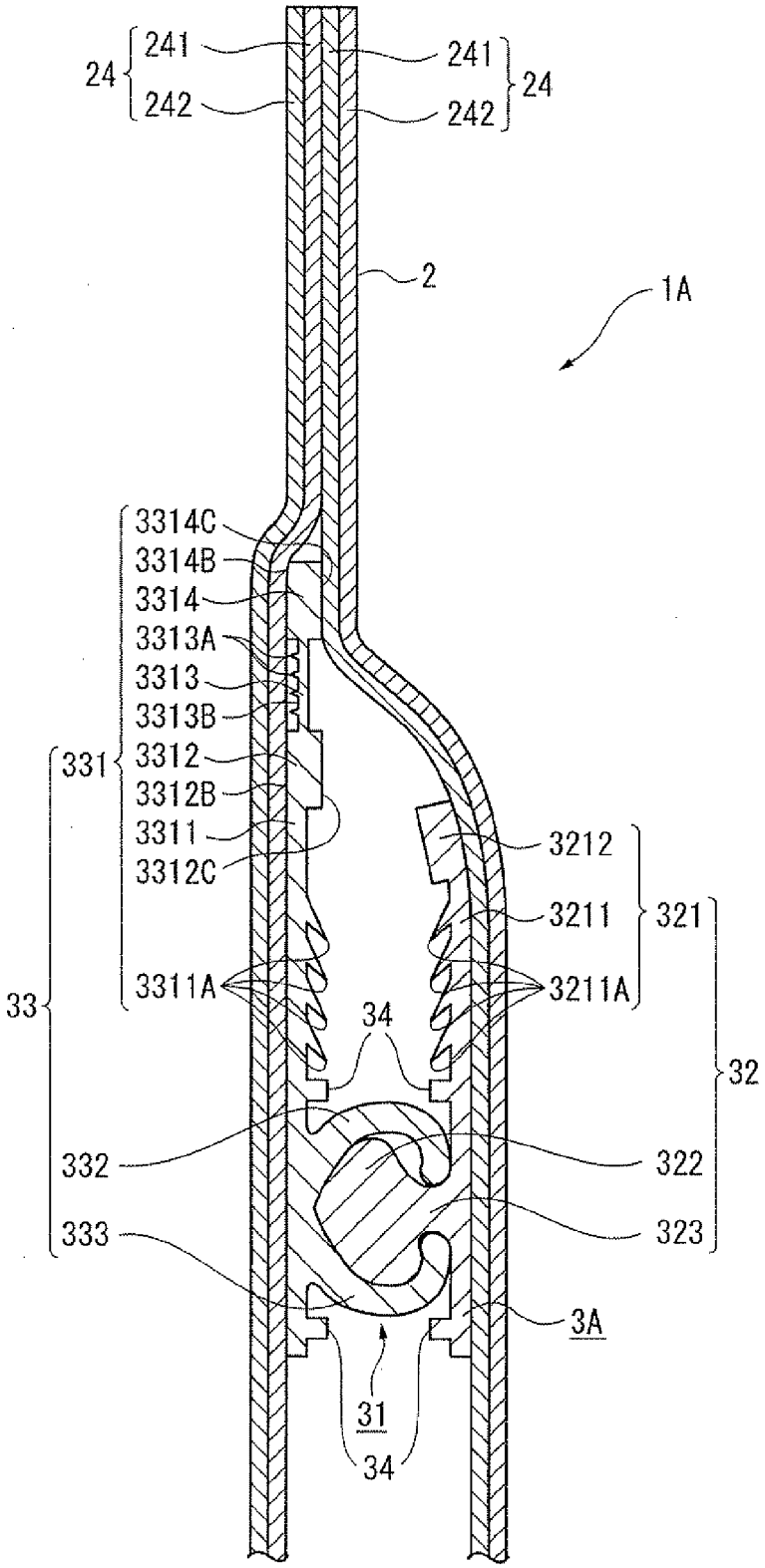
FIG. 2 is a cross sectional view taken along II-II line in FIG. 1.

FIG. 1 s a front view showing a packaging bag provided with a zipper tape according to the exemplary embodiment of the invention. FIG. 2 is a cross sectional view taken along II-II line in FIG. 1.

As shown in FIG. 1, a packaging bag 1A provided with a zipper tape according to the exemplary embodiment includes a bag body 2, which is a packaging bag provided by overlaying base material films 24 (packaging material) with each other and forming side seal portions 21 and a top seal portion 22 on the periphery thereof. An easily tearable zipper tape 3A is attached to an inner surface of an opening 23, through which contents are inserted, of the bag body 2.

Figure 3:
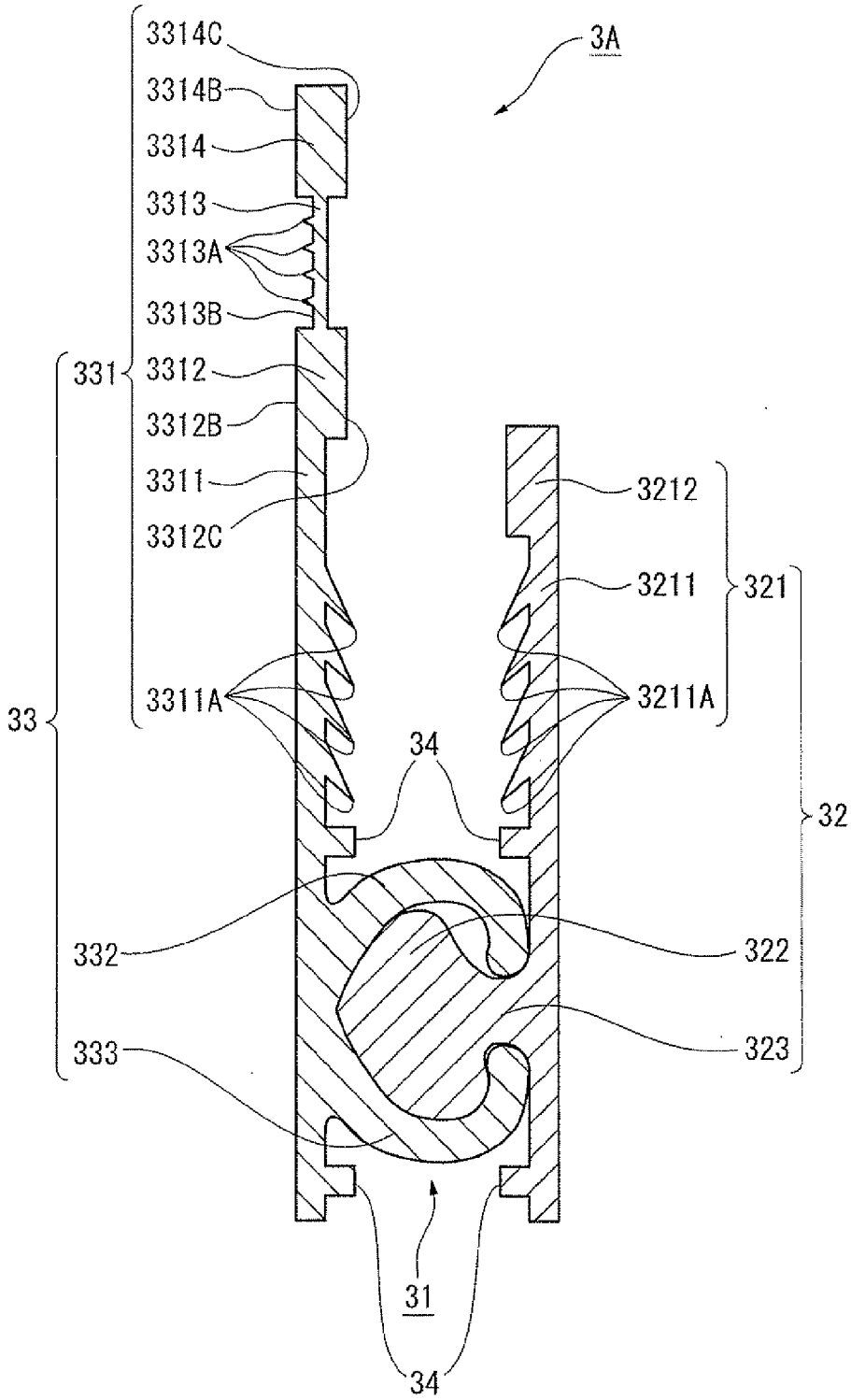
FIG. 3 is a cross sectional view showing the zipper tape according to the exemplary embodiment.

FIG. 3 is a cross sectional view showing the easily tearable zipper tape 3A.

The easily tearable zipper tape 3A includes a pair of a male member 32 and a female member 33.

The male member 32 is integrally formed with a belt-like base 321 that is, for instance, fused to the bag body 2, a head 322 having a substantially arrow-tip shaped cross section, and a connecting portion 323 that connects the head 323 to the belt-like base 321.

Similarly to the male member 32, the female member 33 is integrally formed with a belt-like base 331 that is, for instance, fused to the bag body 2, and a first hook 332 and a second hook 333 that are connected to the belt-like base 331, the first hook 332 and the second hook 333 having an arc cross section and facing each other.

An arrangement of the male member 32 and the female member 33 is not limited to the arrangement that the male member 32 and the female member 33 are fused to the bag body 2. For instance, the male member 32 and the female member 33 may be attached to the bag body 2, for instance, with an adhesive agent.

An engagement portion 31 is provided by the head 322 of the male member 32 and the first and second hooks 332 and 333 of the female member 33, which are disengaged and engaged to open and re-close the easily tearable zipper tape 3A.

The belt-like base 331 includes a longitudinally belt-like main body 3311 on which the first and second hooks 332 and 333 are provided. A first projecting portion 3312, which is formed thicker than the main body 3311, is continuously formed with the main body 3311 at a longitudinal end of the main body 3311 near an opening 23 when the main body 3311 is attached to the bag body 2. Further, a thin portion 3313, which is formed thinner than the first projecting portion 3312, is continuously formed with the first projecting portion 3312 near the opening 23. Moreover, a second projecting portion 3314, which is formed thicker than the main body 3311 and the thin portion 3313, is continuously formed with the thin portion 3313 near the opening 23.

A surface 3312B of the first projecting portion 3312 near the base material film 24 and a surface 3314B of the second projecting portion 3314 near the base material film 24 are formed to be substantially coplanarly positioned. The thin portion 3313 is recessed in a thickness direction relative to surfaces of the first and second projecting portions 3312 and 3314. In other words, the thin portion 3313 is shaped like a step toward an inside of the bag body 2.

Further, the thin portion 3313 is also recessed relative to a surface 3312C of the first projecting portion 3312 near the engagement portion 31 and a surface 3314C of the second projecting portion 3314 near the engagement portion 31. In other words, the thin portion 3313 is shaped like a step toward the base material film 24.

With this arrangement, the belt-like base 331 is attached to the base material film 24 while the thin portion 3313 faces the base material film 24 with a gap therebetween.

A thickness of the thin portion 3313 is preferably 0.12 mm or less. In this exemplary embodiment, the thickness of the thin portion 3313 is set at 0.1 mm. A thickness of the main body 3311 is preferably 0.15 mm. A thickness of each of the first and second projecting portions 3312 and 3314 of the main body 3311 is preferably in a range from 0.20 mm to 1 mm, which may exemplarily be set at 0.3 mm.

A width of the thin portion 3313 is preferably in a range from 0.5 mm to 5 mm, more preferably from 1 mm to 3 mm. In this exemplary embodiment, the width is set at 2 mm.

Projecting ribs 3313A each having a triangular cross section are provided in plural lines on a surface near the base material film 24. The ribs 3313A are preferably formed such that a height of each of the ribs 3313A is lower than the step relative to the first projecting portion 3312 and the second projecting portion 3314, and a tip of each of the ribs 3313A does not project beyond a plane defined by the surface 3312B of the first projecting portion 3312 near the base material film 24 and the surface 3314B of the second projecting portion 3314 near the base material film 24.

Moreover, when the thickness of the thin portion 3313 is defined as 1, a total thickness of the thin portion 3313 and the ribs 3313A is preferably from 1.1 times to 5 times as thick as the thin portion 3313.

In the invention, the thin portion 3313 and the ribs 3313A are preferably arranged not to be bonded to an inner surface of the bag body 2. The easily tearable zipper tape 3A may be multi-layered, in which a seal layer is preferably provided on a portion except for the thin portion 3313. With this arrangement, the thin portion 3313 becomes difficult to be bonded to the inner surface of the bag body 2.

On the main body 3311 of the belt-like base 331, return ribs 3311A are provided in plural lines between the engagement portion 31 and the first projecting portion 3312 and on a flat surface of the main body 3311 near the inside of the bag body 2. The return ribs 3311A are formed such that a tip of each of the return ribs 3311A projects opposite to the opening 23 of the bag body 2. The return ribs 3311A are formed to have approximately the same height relative to the main body 3311 as the height of the first projecting portion 3312 relative to the main body 3311 and the height of the second projecting portion 3314 relative to the main body 3311.

At the engagement portion 31 on the belt-like base 331, rib-like portions 34 are respectively formed near the opening 23 and on the opposite side of the engagement portion 31 from the opening 23. Similarly to the return ribs 3311A, the rib-like portions 34 are also formed to have approximately the same height as the height of the first projecting portion 3312 relative to the main body 3311 and the height of the second projecting portion 3314 relative to the main body 3311.

The belt-like base 321 also include a longitudinally belt-like main body 3211 on which a head 322 and a connection portion 323 are provided. A first projecting portion 3212, which is formed thicker than the main body 3211, is continuously formed with the main body 3211 at a longitudinal end of the main body 3211 near the opening 23 when the main body 3211 is attached to the bag body 2.

A distance between the first projecting portion 3212 and the engagement portion 31 (in a mated state) is formed shorter than a distance between the first projecting portion 3312 of the belt-like base 331 and the engagement portion 31. With this arrangement, the first projecting portion 3212 and the first projecting portion 3312 are formed to be positioned at different levels.

Similarly to the return ribs 3311A of the belt-like base 331, return ribs 3211A are provided on the belt-like base 321 at a position corresponding to the return ribs 3311A.

Similarly to the belt-like base 331, at the engagement portion 31 on the belt-like base 321, rib-like portions 34 are respectively formed near the opening 23 and opposite to the opening 23 across the engagement portion 31.

On surfaces of the male member 32 and the female member 33, except for the thin portion 3313 and the ribs 3313A, to be attached to the inner surface of the bag body 2, resins having a lower melting point than a melting point of the thin portion 3313 and the ribs 3313A may be laminated in the same manner as in the above-described multi-layered structure provided with a seal layer. This arrangement provides advantages to prevent the ribs 3313A from being erroneously fused on the inner surface of the bag body 2.

When the easily tearable zipper tape 3A with such an arrangement is fused on the inner surface of the bag body 2, a gap is formed between a surface 3313B of the thin portion 3313 of the female member 33 and the base material film 24 of the bag body 2.

Further, while the easily tearable zipper tape 3A and the top and bottom base material films 24 are superposed, V-shaped notches 25 that provide an opening start position are provided on either end of the thin portion 3313 (FIG. 1).

Manufacturing of Easily Tearable Zipper Tape

The easily tearable zipper tape 3A can be integrally manufactured by a co-extrusion molding. With the use of co-extrusion molding for manufacturing the zipper tape 3A, the manufacturing step can be simplified, the manufacturing cost can be lowered and the zipper tape 3A can be continuously manufactured in a stable manner.

Any material may be used for producing the male member 32 and female member 33 of the easily tearable zipper tape 3A as long as the male and female members are reclosable. However, it is preferable that polyolefin-base resins including typical polyethylene-base resins such as low-density polyethylene and linear low-density polyethylene and polypropylene-base resin are used. Examples of the polypropylene-base resins are thermoplastic resin such as homo-polypropylene, block polypropylene, random polypropylene (RPP), propylene-ethylene-butene-1-random ternary copolymer, polyolefinic specialty soft resin (TPO resin. e.g. prime polymer TPO) and mixture of the resins.

The base material film 24 (packaging material) forming the bag body 2 is preferably a laminate film in which a sealant layer 241 is laminated on a base layer 242. However, in accordance with the performance desired, a laminate film in which an intermediate layer (not shown) such as a gas-barrier layer, light-shielding layer and strength-improving layer is laminated between the base layer 242 and the sealant layer 241 may alternatively be used.

As well as biaxially oriented polypropylene film (OPP film), a biaxially oriented polyester film such as a biaxially oriented polyethylene terephthalate film (PET film) and a biaxially oriented polyethylene naphthalate film (PEN film), and a biaxially oriented polyamide film such as nylon 6, nylon 66 and MXD6 (poly-(meta-xylylene adipamide)) can be suitably used for the base layer 242. Alternatively, various engineering plastic films may be used as necessary. These films may be singularly used or a combination of a plurality of the films may be laminated.

When the intermediate layer is a gas-barrier layer, the intermediate layer may be provided by a film of saponified ethylene-vinyl acetate copolymer (EVOH), polyvinylidene chloride (PVDC) and polyacrylonitrile (PAN), aluminum foil, a vapor-deposition layer of silica, alumina, aluminum and the like, or a coating layer of PVDC.

When a vapor-deposition layer of silica, alumina and aluminum or a coating film layer of PVDC is used as the intermediate layer, the intermediate layer may be vapor-deposited or coated on the inner surface of the base layer 242. Alternatively, the layer may be vapor-deposited or coated on a separate biaxially oriented nylon film (ONy film), biaxially oriented polyethylene terephthalate film (PET film), biaxially oriented polypropylene film (OPP film) and the like and thus prepared film may be laminated on the intermediate layer.

In the above, since aluminum foil and aluminum vapor-deposited layer are opaque, aluminum foil and aluminum vapor-deposited layer can also work as a light-shielding layer.

When the base layer 242 and the film of the intermediate layer are laminated, known dry lamination method or extrusion lamination method (sandwich lamination method) may be employed.

Low-density polyethylene, polypropylene (CPP) and the like can be used as the innermost sealant layer 241.

Incidentally, in order to laminate the sealant layer 241, the above resins may be formed as a film, which is to be laminated by a dry lamination or an extrusion lamination. Alternatively, the above resins may be laminated by extrusion coating to obtain the base material film 24.

With the use of thus obtained base material film 24 and the easily tearable zipper tape 3A, the packaging bag 1A provided with the zipper tape is manufactured by a zipper-tape-attaching three-side seal bag-making machine and the like.

The zipper-tape-attaching three-side seal bag-making machine includes a package material feeder, a tape feeder and a zipper tape bonding section. After a pair of the base material films 24 are fed from the package material feeder, the easily tearable zipper tape 3A fed from the tape feeder is disposed between the pair of the base material films 24 and the zipper tape 3A and the base material films 24 are bonded at the zipper tape bonding section. Subsequently, the base material films 24 are transferred to be bonded and melt-cut at a predetermined interval in the transferring direction of the base material film 24 to form the packaging bag 1A provided with the easily tearable zipper tape.

When the side seal portion 21 of the packaging bag 1A provided with the easily tearable zipper tape is formed, a point seal process for collapsing the easily tearable zipper tape 3A is required.

Opening of Packaging Bag with Easily Tearable Zipper Tape

Next, an opening process of the packaging bag 1A provided with the zipper tape of the exemplary embodiment will be described below.

For opening the bag, at one of the notches 25 provided on either end of the thin portion 3313, the base material film 24 near the opening 23 and the base material film 24 near the contents are held to tear the bag in a direction opposing with each other from the notch 25 (cut start position). Consequently, the thin portion 3313 and the opposing base material films 24 can be torn at one time.

Then, the engagement portion 31 of the zipper tape 3A is disengaged to open the packaging bag 1A provided with the zipper tape. When being re-closed, the male member 32 and the female member 33 are engaged to bring the engagement portion 31 into an engaged state.

Advantages of Exemplary Embodiment

According to the above-described easily tearable zipper tape 3A and the packaging bag 1A provided with the easily tearable zipper tape, following advantages can be achieved.

Since the easily tearable zipper tape 3A of this exemplary embodiment is provided with the thin portion 3313 on the belt-like portion 331, the zipper tape 3A can be easily cut along the thin portion 3313 when the packaging bag 1A provided with the easily tearable zipper tape is opened.

Further, since the first and second projecting portions 3312 and 3314 respectively provided on longitudinal ends of the thin portion 3313 are thicker than the thin portion 3313, even when a cutting line goes out of the thin portion 3313 in opening the bag, the first and second projecting portions 3312 and 3314 are not to be cut and the cutting line is guided between the first and second projecting portions 3312 and 3314, which facilitates an opening operation.

Furthermore, in the exemplary embodiment, since the thin portion 3313 is provided only in the belt-like base 331, a tearing force required in opening the bag is only enough to tear the thin portion 3313, which is provided between the first and second projecting portions 3312 and 3314 guiding to a tearing position, and the bag body 2. The tearing force is smaller than a tearing force required when the thin portion 3313 is also similarly provided in the belt-like base 321, which can further improve openability.

The ribs 3313A are provided on the thin portion 3313.

This arrangement can prevent an increase in a tearing force which is caused by an extended thin portion 3313 in opening the bag and also can prevent the thin portion 3313 from failing to exhibit cuttability which is caused by, for instance, that the thin portion 3313 is bent by external force and the like in manufacturing and the bent thin portion 3313 is attached to the bag body 2. Accordingly, the easily tearable zipper tape 3A can be manufactured from soft materials, which removes the limitation of materials and improves productivity.

Since the ribs 3313A are provided in the plural lines, rigidity of the thin portion 3313 against external force is further improved to make the thin portion 3313 less bendable and realize cuttability of the thin portion 3313 more reliably.

The easily tearable zipper tape 3A is continuously formed of a single common material.

Accordingly, the easily tearable zipper tape 3A can be manufactured by, for instance, co-extrusion in a single step, which facilitates improvement in productivity and reduction in the manufacturing cost.

The thickness of the thin portion 3313 is 0.12 mm or less. The thickness of each of the first and second projecting portions 3312 and 3314 is in a range from 0.20 mm to 1 mm. The width of the thin portion is in a range from 0.5 mm to 5 mm.

Accordingly, the thin portion 3313 is easily cuttable and the first and second projection portions 3312 and 3314 are less cuttable. Consequently, the zipper tape is easily cuttable along the thin portion 3313, so that linearity as well as easy-tearability can be provided to the cutting line. Further, since the first and second projecting portions 3312 and 3314 are not too thick, an excellent sealability is exhibited without influencing on processability.

Since the return ribs 3211A and 3311A are provided, disadvantages caused by the main bodies 3211 and 3311 being bent in manufacturing can be avoided. Since the return ribs 3211A and 3311A are formed to have approximately the same height as the height of the first and second projecting portions 3312 and 3314, when the easily tearable zipper tape 3A is fused to the base material film 24, a seal bar can be brought into even contact with an almost entire surface of the easily tearable zipper tape 3A. Consequently, the easily tearable zipper tape 3A can be securely and stably fused to the base material film 24.

Likewise, since the rib-like portions 34 are provided, an almost entire surface of the easily tearable zipper tape 3A can be fused to the base material film 24 even with the engagement portion 31 having a large thickness.

The first projecting portion 3212 and the first projecting portion 3312 are provided to have different distances from the engagement portion 31.

Accordingly, when the bag is opened, the opposing base material films 24 are cut at different levels.

Consequently, when the re-closed packaging bag 1A is re-opened, the base material films 24 at the opening 23 can be easily pinched for an easy re-opening operation.

The first and second projecting portions 3312 and 3314 are formed thicker than the main body 3311. Accordingly, deformation of the male member 32 and the female member 33, which is caused by an extremely high temperature for sealing the easily tearable zipper tape 3A, can be prevented. The easily tearable zipper tape 3A is cut along the guiding first and second projecting portions 3312 and 3314, thereby easily opening the bag.

Modification

It should be understood that the scope of the present invention is not limited to the above-described exemplary embodiments, but includes modifications and improvements as long as the modifications and improvements are compatible with the invention. Further, the specific arrangements and configurations may be altered in any manner as long as an object and effect of the invention can be achieved.

It is exemplarily described that the thin portion 3313 is provided in the belt-like base 331. However, the thin portion 3313 may be provided in the belt-like base 321, or in both of the belt-like base 331 and the belt-like base 321.

The thickness and the width of the thin portion 3313 are not limited to the above arrangement, but may be appropriately set depending on usage and materials.

It is exemplarily described that the ribs 3313A provided on the thin portion 3313 are in plural lines, but may be in a single line. A profile of the rib is not limited to a cross-sectional triangle along a longitudinal direction of the thin portion 3313, but may be, for instance, a cross-sectional quadrangle, a cross-sectional semi-circle and a cross-sectional ellipse. A plurality of the ribs may be arranged to project in a dotted manner. Further, the profile of the rib is not limited to the linear profile along the longitudinal direction of the thin portion 3313, but may be corrugated profile.

In order to provide a linear cutting line, the profile of the rib is preferably the linear profile along the longitudinal direction of the thin portion 3313 as in the above exemplary embodiment.

It is exemplarily explained that the ribs are provided on a surface of the thin portion 3313 near the base material film 24. However, the ribs may be provided on an opposite surface of the thin portion 3313, or on both of the surfaces.

In the exemplary embodiment, the rib-like portions 34 are provided on the main body 3211 of the belt-like base 321 and on either side of the engagement portion 31. The rib-like portions 34 are also provided on the main body 3311 of the belt-like base 331 and on either side of the engagement portion 31. However, the rib-like portions 34 may not be provided. The rib-like portion 34 provided on each side may be plural.

It is exemplarily explained that the return ribs 3211A and 3311A are provided, but the return ribs 3211A and 3311A may not be provided.

Although the easily tearable zipper tape 3A is fused to the base material film 24, the easily tearable zipper tape 3A may be attached to the base material film 24 with an adhesive agent and the like.

Further, although the package on which the easily tearable zipper tape 3A is welded is a three-side seal bag in the above exemplary embodiment, the invention can be also applied to a pillow bag, a side gusset bag or a four-side seal bag.

Other specific arrangements and shapes for carrying out the invention may be altered as long as an object of the invention is achieved.

EXAMPLES

An easily tearable zipper tape was manufactured under different conditions as in the following examples and comparative example. Subsequently, tearing resistance and flexion strength were examined.

Example 1

An easily tearable zipper tape including a pair of male member and a female member was obtained by co-extrusion. The used resin, the length of the thin portion and the thickness of the respective portions were as follows:

Zipper tape (female member): polyethylene (density 913 kg/m$^3$, MFR 4.0 g/10 min)

Thin portion: polyethylene (same as the above)

Width of thin portion (female member): 1.5 mm

Thickness of thin portion (female member): 60 μm

Total thickness of rib and thin portion: 135 μm (ribs are only provided on the thin portion facing the engagement portion)

Number of ribs: 4

Example 2

An easily tearable zipper tape was obtained in the same manner as in Example 1 except for the thickness of the thin portion and the total thickness of the thin portion and the rib.

Thickness of thin portion (female member): 75 μm

Total thickness of rib and thin portion: 170 μm (ribs are only provided on the thin portion facing the engagement portion)

Example 3

An easily tearable zipper tape was obtained in the same manner as in Example 1 except for the thickness of the thin portion, the total thickness of the thin portion and the rib, and the number of the ribs.

Thickness of thin portion (female member): 75 μm

Total thickness of rib and thin portion: 200 μm (ribs are only provided on the thin portion facing the engagement portion)

Number of ribs: 8

Comparative Example 1

An easily tearable zipper tape was obtained in the same manner as Example 1 except that a rib is not provided.

Evaluation of Tearing Resistance

12 μm of a polyethylene terephthalate film, and 50 μm of a linear low-density polyethylene film were dry-laminated to provide a film. The obtained film and an easily tearable zipper tape (female member) were bonded to each other by heat seal and cut by a 30-mm length in a width direction of a bag.

A 10-mm deep notch was formed in the thin portion of the easily tearable zipper tape bonded to the film. The zipper tape was torn away by a tensile tester. The maximum value of the tearing resistance was defined as strength and evaluated according to the following evaluation levels. The results are shown in Table 1.

Evaluation A: tearing resistance of less than 6 N/20 mm

Evaluation B: tearing resistance from 6 N/20 mm or more to less than 8 N/20 mm

Evaluation C: tearing resistance from 8 N/20 mm or more to less than 10 N/20 mm

Sensory Evaluation of Tearing Resistance

12 μm of a polyethylene terephthalate film, and 50 μm of a linear low-density polyethylene film were dry-laminated to provide a film. The obtained film and an easily tearable zipper tape (female member) were bonded to each other by heat seal and cut in a 20-cm length.

A 3-mm deep notch was formed in the thin portion of the easily tearable zipper tape bonded to the film. The zipper tape was torn by hands towards a surface where an engagement portion is provided in a 10-cm length and away from the surface in the rest 10-cm length. Tearing resistance of the thin portion at each time was checked and evaluated according to the following sensory evaluation levels. The results are shown in Table 1.

Evaluation A: no change of tearing resistance irrespective of tearing directions Evaluation B: small change of tearing resistance depending on the tearing directions Evaluation C: occasional change of tearing resistance depending on the tearing directions Flexion Strength By using a zipper tape guide having a concave cross section, an easily tearable zipper tape was rolled up around a drum roller while being oscillated so that the easily tearable zipper tape was shifted by 10 mm at one roll. At this time, flexion conditions of the thin portion at the zipper tape guide were checked and evaluated according to the following evaluation levels. The results are shown in Table 1.

Evaluation B: 0 degree or more to less than 45 degrees of flexion strength after one roll Evaluation C: 45 degree or more to less than 90 degrees of flexion strength after one roll Evaluation D: 90 degree or more of flexion strength after one roll

TABLE 1

| | Tearing Resistance | Sensory Evaluation | Flexion Strength | Total Evaluation |
|---|---|---|---|---|
| Example 1 | A | B | C | B |
| Example 2 | B | B | B | B |
| Example 3 | B | A | B | A |
| Comparative 1 | B | C | C | C |

From the results shown in Table 1, it is recognized that tearing resistances differ depending on the tearing directions when the ribs are not provided, but tearing resistances do not change irrespective of the tearing directions or change small depending on the tearing directions when the ribs are provided, thereby improving openability.

When the ribs are not provided, the zipper tape is cut between the first projecting portion or second projecting portion and the thin portion. However, when such a cutting is off the cutting line of the film, tearing resistance may be increased. When the ribs are provided, the zipper tape is cut between ribs on the thin portion, the ribs being the closest to the cutting line of the film, or between one of the projecting portions and a rib, thereby reducing tearing resistance.

According to these various evaluations, in terms of easy tearability and cuttability, Examples 1 to 3 are favorable as compared with Comparative Example 1, among which Example 3 is particularly favorable.

The invention claimed is:

1. A zipper tape comprising:

an engagement portion at which a pair of male member and a female member are adapted to be mated with each other; and at least two belt-like bases provided continuously to the engagement portion, wherein at least one of the belt-like bases comprises a main body on which the engagement portion is provided;

a thin portion being thinner than a main body, a projecting portion being thicker than the main body located between the engagement portion and the thin portion; and a rib provided on at least one surface of the thin portion.

2. The zipper tape according to claim 1, wherein the rib is provided on both surfaces of the thin portion.

3. The zipper tape according to claim 1, wherein the rib is a plurality of the ribs.

4. The zipper tape according to claim 1, wherein the thin portion is recessed in a thickness direction relative to at least one surface of a first and second projecting portions.

5. The zipper tape according to claim 1, wherein the thin portion is recessed in a thickness direction relative to both surface of a first and second projecting portions.

6. The zipper tape according to claim 1, wherein the thin portion is provided in both of the belt-like bases.

7. The zipper tape according to claim 1, wherein the rib is the linear profile along a longitudinal direction of the thin portion.

8. The zipper tape according to claim 1, wherein return ribs are provided along a longitudinal direction of the belt-like bases and are located between the engagement portion and the thin portion.

9. A packaging bag, comprising:

an inner surface having an opening through which contents are fed; and the zipper tape according to claim 1 attached to said inner surface of said packaging bag.

10. The packaging bag according to claim 9, wherein the thin portion of the zipper tape is not bonded to said inner surface of said packaging bag.

11. The packaging bag according to claim 9, wherein the zipper tape and a top and bottom base material films are superposed, and V-shaped notches that provide an opening start position are provided on either end of the thin portion.

12. A zipper tape comprising:

an engagement portion at which a pair of a male member and a female member are adapted to be mated with each other; and belt-like bases provided continuously on the male member and the female member on which the engagement portion is provided, wherein at least one of the belt-like bases comprises:

a main body on which the engagement portion is provided;

a first projecting portion provided on the main body, the first projecting portion being thicker than the main body;

a thin portion provided adjacent to the first projecting portion, the thin portion being thinner than the first projecting portion and the main body;

a second projecting portion provided adjacent to the thin portion, the second projecting portion being thicker than the thin portion and the main body; and a rib provided on at least one surface of the thin portion.

13. The zipper tape according to claim 12, wherein the rib is provided on both surfaces of the thin portion.

14. The zipper tape according to claim 12, wherein the rib is a plurality of the ribs.

15. The zipper tape according to claim 14, wherein a distance between the ribs is in a range from 0.05 mm to 2 mm.

16. The zipper tape according to claim 12, wherein the rib is formed to be from 1.1 times to 5 times as thick as the thin portion.

17. The zipper tape according to claim 12, wherein a thickness of the thin portion is greater than 0 but no more than 0.12 mm, and a thickness of each of the first projecting portion and the second projecting portion is in a range from 0.20 mm to 1 mm.

18. The zipper tape according to claim 12, wherein a width of the thin portion is in a range from 0.5 mm to 5 mm.

19. The zipper tape according to claim 12, wherein the thin portion, the first projecting portion and the second projecting portion are formed of the same resin or resins.

20. A packaging bag, comprising:

an inner surface having an opening through which contents are fed; and the zipper tape according to claim 12 attached to said inner surface of said packaging bag.

21. The packaging bag according to claim 20, wherein the thin portion of the zipper tape is not bonded to said inner surface of said packaging bag.

22. The zipper tape according to claim 12, wherein the thin portion is recessed in a thickness direction relative to at least one surface of the first and second projecting portions.

23. The zipper tape according to claim 12, wherein the thin portion is recessed in a thickness direction relative to both surfaces of the first and second projecting portions.

24. The zipper tape according to claim 12, wherein the thin portion is provided in both of the belt-like bases.

25. The zipper tape according to claim 12, wherein the rib is the linear profile along a longitudinal direction of the thin portion.

26. The zipper tape according to claim 12, wherein return ribs are provided along a longitudinal direction of the belt-like bases and are located between the engagement portion and the thin portion.

27. The packaging bag according to claim 20, wherein the zipper tape and a top and bottom base material films are superposed, and V-shaped notches that provide an opening start position are provided on either end of the thin portion.

* * * * *